US006971309B2

(12) United States Patent
Birkenfeld et al.

(10) Patent No.: US 6,971,309 B2
(45) Date of Patent: Dec. 6, 2005

(54) WEB-FED ROTARY PRESS

(75) Inventors: Andreas Birkenfeld, Dinkelscherben (DE); Peer Dilling, Friedberg (DE); Robert Kersch, Augsburg (DE); Wolfgang Zeller, Gersthofen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/669,579

(22) Filed: Sep. 24, 2003

(65) Prior Publication Data

US 2004/0060463 A1 Apr. 1, 2004

(30) Foreign Application Priority Data

Sep. 27, 2002 (DE) ..... 102 45 321

(51) Int. Cl.[7] ..... B41F 13/02; B41F 1/54; B41F 17/00

(52) U.S. Cl. ..... 101/219; 101/143; 101/168; 101/220; 101/221; 101/222; 101/223; 101/228; 101/232; 101/373; 101/483; 101/484; 101/485; 101/488

(58) Field of Search ..... 101/219–225, 101/143, 168, 228, 232, 483, 484, 485, 488, 101/373

(56) References Cited

U.S. PATENT DOCUMENTS

| | | | | |
|---|---|---|---|---|
| 2,788,743 | A * | 4/1957 | Schwerin | 101/389.1 |
| 3,696,745 | A * | 10/1972 | Morton | 101/415.1 |
| 3,897,191 | A * | 7/1975 | Saunders et al. | 425/384 |
| 4,538,516 | A | 9/1985 | Aaron | |
| 4,549,917 | A * | 10/1985 | Jensen, Jr. | 156/108 |
| 4,833,486 | A * | 5/1989 | Zerillo | 347/2 |
| 4,858,123 | A * | 8/1989 | Alexoff et al. | 101/484 |
| 4,870,434 | A | 9/1989 | Negishi et al. | |
| 5,205,039 | A * | 4/1993 | Ternes | 29/895.21 |
| 5,327,829 | A * | 7/1994 | Miyoshi et al. | 101/177 |
| 5,894,319 | A * | 4/1999 | Okamura et al. | 347/264 |
| 5,967,032 | A * | 10/1999 | Bravenec et al. | 101/211 |
| 6,145,435 | A * | 11/2000 | Richards | 101/180 |
| 6,408,747 | B2 * | 6/2002 | Koppelkamm et al. | 101/147 |
| 6,510,791 | B1 * | 1/2003 | Hillebrand et al. | 101/231 |

FOREIGN PATENT DOCUMENTS

| | | |
|---|---|---|
| AT | 329 600 | 5/1976 |
| DE | 100 16 409 | 6/2001 |

* cited by examiner

*Primary Examiner*—Andrew H. Hirshfeld
*Assistant Examiner*—Marvin P Crenshaw
(74) *Attorney, Agent, or Firm*—Cohen, Pontani, Lieberman & Pavane

(57) ABSTRACT

In order to create preconditions, in a web-fed rotary press, for good format variability of the printed products and economic utilization of the printing material, at least two printed pages of different heights are arranged in the circumferential direction on a form cylinder.

6 Claims, 2 Drawing Sheets

WEB-FED ROTARY PRESS

BACKGROUND OF THE INVENTION

1. Field of the Invention

The invention relates to a web-fed rotary press having at least one printing unit comprising a forme cylinder and an impression cylinder.

2. Description of the Related Art

A printing unit of a web-fed rotary press comprises at least one forme cylinder and one impression cylinder. The printing image of a printing plate, which is located on the forme cylinder, is transferred to a web as the web is passed between the two cylinders set against one another. Printing may also take place indirectly, the printing image being transferred from the forme cylinder initially onto a transfer cylinder and from there onto the web.

A printing plate, which comprises one or more printed pages of equal length in the circumferential direction of the forme cylinder, is located on the forme cylinder. A printed page 1 of this type, the height L of which corresponds to the circumference of the forme cylinder, is shown in FIG. 1. The printed page 1 comprises a region in which copies 2, which may also be referred to as pages, to be printed are arranged, and a region in which marks for monitoring and control purposes are printed. In the following text, this region is called control strip 3. The printed page 1 is printed cyclically onto a web with every rotation of the forme cylinder and cut off in a cross-cutting apparatus.

Furthermore, web-fed rotary presses are known in which two printed pages of identical height L/2 are arranged in the circumferential direction of the forme cylinder (FIG. 2). It is also known to arrange, for example, three printed pages of identical height on the cylinder circumference. It is a disadvantage of this multiple arrangement of printed pages 4 that, in the case of copies 2 being identically arranged in the two printed pages 4, the region for a control strip remains unused, as it is sufficient to print one control strip per rotation of the forme cylinder. An unprintable region, caused by a clamping channel, is also provided in each printed page 4. The region of the printing plate which can be used for printing is therefore poorly utilized. Moreover, the number of possible format lengths is limited to a few identical circumferential parts of the forme cylinder.

SUMMARY OF THE INVENTION

It is an object of the invention to create preconditions, in a web-fed rotary press, for good format variability of the printed products and economic utilization of the printing material.

The object is achieved according to the invention by using a printing plate which can print two printed pages arranged contiguously in the circumferential direction and having different heights. Arranging printed pages of different heights makes it possible to utilize the available printable region well within the circumferential format of the printing press and to provide control strips or the space for them only in the necessary amount and to combine them largely freely with the printed pages. It is also necessary to provide an unprintable region only once in the circumferential format as a result of a clamping channel.

The invention is to be explained in greater detail in the following text using an example.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Figure 1:
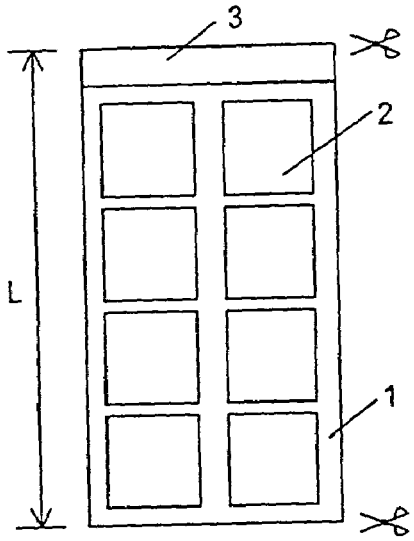
Prior art Fig. 1
FIGS. 1 and 2 show printed page arrangements on a forme cylinder according to the prior art.
Figure 2:
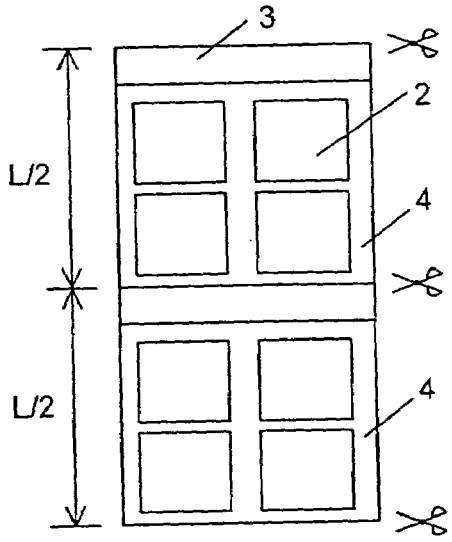
Prior art Fig. 2
Figure 3:
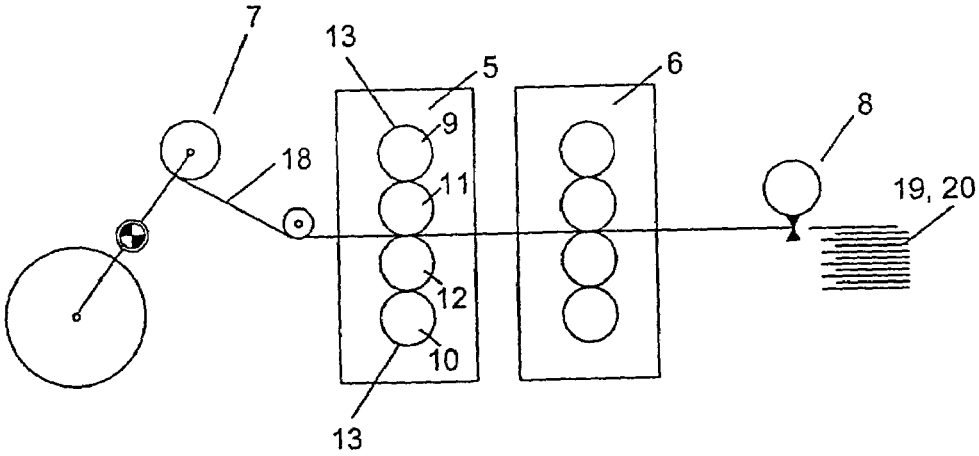
FIG. 3 shows a web-fed rotary press having a cross-cutting apparatus.

The printing press shown in FIG. 3 comprises, for example, two printing units 5, 6, an unwinding apparatus 7 and a cross-cutting apparatus 8. The printing units 5, 6 operate according to the offset printing process, but could also operate according to the gravure or letterpress printing process. A three-cylinder printing unit can also be used if the forme cylinder 10 is omitted. Furthermore, the transfer cylinder 11 can also be omitted, a direct printing process then being used and the transfer cylinder 12 being configured as an impression cylinder.

Figure 5:
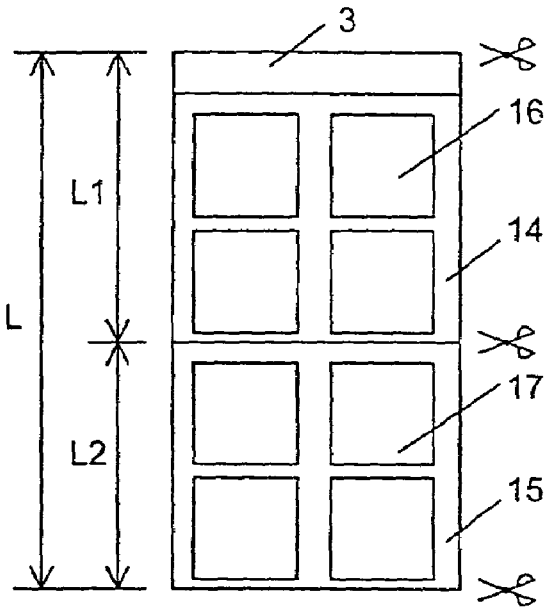
FIG. 5 shows the arrangement according to the invention of printed pages on a forme cylinder.

The forme cylinder 9 bears a printing plate 13, on which two printed pages 14, 15 with the different heights L1 and L2 are arranged in the circumferential direction (FIG. 5). Furthermore, a control strip 3 is contained in the printed page 14, in the region of which printing images for monitoring and machine-internal control purposes are contained, for example printing marks and register crosses. It is also possible for an unprintable region caused by a clamping channel to be contained in one of the two printed pages 14, 15. Furthermore, the printed page 14 contains printing images for copies 16 and the printed page 15 contains printing images for copies 17. The printing plate 13 can be configured as a sleeve or a finite plate. It is also possible to inscribe the printing plate directly onto the surface of the forme cylinder 9. It is likewise possible for a number of printing plates to be fastened in the circumferential direction of the forme cylinder, and for a number of printing plates 13 to be fastened on the forme cylinder 9 next to one another in the axial direction. It is also possible for the printed pages 14, 15, shown in FIG. 5, to be arranged on the forme cylinder 9 in multiple fashion next to one another. The forme cylinder 10 is equipped in identical fashion with a printing plate and printed pages.

Figure 4:
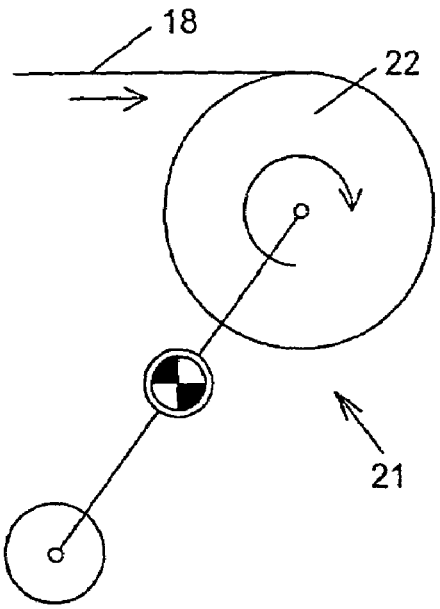
FIG. 4 shows a winding apparatus.

A web 18 which is unwound by the unwinding apparatus 7 is fed to the printing unit 5 and printed on both sides with the printing images of the printed pages 14, 15 shown in FIG. 5. Subsequently, the next colour is printed onto the printed pages 14, 15 in register when the printing unit 6 is passed through. After this, the web 18, which has been printed with the cyclical sequence of the printed pages 14 and 15, is cut, by means of the cross-cutting apparatus 8, into sheets 19, 20 having cut-off lengths corresponding to the heights L1 and L2. Instead of the cross-cutter 8, it is also possible to use a winding apparatus 21, by means of which the web 18 is wound up to form a roll 22 (FIG. 4).

It is also possible to provide more than two printed pages 14, 15 of different heights on the circumference of the forme cylinder, the allocation of control strips being largely arbitrary.

The invention is not limited by the embodiments described above which are presented as examples only but can be modified in various ways within the scope of protection defined by the appended patent claims.

We claim:

1. A web-fed rotary printing press having at least one printing unit, said printing unit comprising:

an impression cylinder over which a web can be passed; and a forme cylinder bearing at least one printing plate having means for printing two printed pages arranged contiguously in the circumferential direction and having different heights, one of said printed pages being printed only with copies and the other of said printed pages being printed with copies and a control strip, whereby, a web passing between said impression cylinder and said forme cylinder can be printed with two consecutive pages having different heights.

2. A web-fed rotary printing press as in claim 1 further comprising a transfer cylinder arranged between said forme cylinder and said impression cylinder.

3. A web-fed rotary printing press as in claim 2 comprising a further forme cylinder and a further transfer cylinder, said further transfer cylinder serving as said impression cylinder.

4. A web-fed rotary printing press as in claim 1 wherein said printing unit is one of a an offset press, a gravure press, and a letterpress printing press.

5. A web-fed rotary printing press as in claim 4 further comprising a winding apparatus for winding up a printed web.

6. A web-fed rotary printing apparatus as in claim 1 further comprising a cross-cutting apparatus by means of which printed pages are cut from said web.

* * * * *